US010062275B2

(12) United States Patent
de Cordes et al.

(10) Patent No.: US 10,062,275 B2
(45) Date of Patent: Aug. 28, 2018

(54) UNIVERSAL EQUIPMENT CONTROL SYSTEM

(71) Applicant: ORANGE, Paris (FR)

(72) Inventors: Nicolas de Cordes, Chatillon (FR); Jean-Marc Raibaud, Antony (FR); Albert Pazuelo, Paris (FR)

(73) Assignee: Orange, Paris (FR)

( * ) Notice: Subject to any disclaimer, the term of this patent is extended or adjusted under 35 U.S.C. 154(b) by 0 days.

(21) Appl. No.: 15/118,309

(22) PCT Filed: Feb. 9, 2015

(86) PCT No.: PCT/FR2015/050296
§ 371 (c)(1),
(2) Date: Aug. 11, 2016

(87) PCT Pub. No.: WO2015/121571
PCT Pub. Date: Aug. 20, 2015

(65) Prior Publication Data

US 2017/0178492 A1 Jun. 22, 2017

(30) Foreign Application Priority Data

Feb. 14, 2014 (FR) ..... 14 51153

(51) Int. Cl.
*G08C 17/02* (2006.01)

(52) U.S. Cl.
CPC ..... *G08C 17/02* (2013.01); *G08C 2201/21* (2013.01); *G08C 2201/92* (2013.01)

(58) Field of Classification Search
None
See application file for complete search history.

(56) References Cited

U.S. PATENT DOCUMENTS

| | | | | |
|---|---|---|---|---|
| 8,836,487 | B2 * | 9/2014 | Shin | G08C 17/02 340/12.1 |
| 9,049,040 | B2 * | 6/2015 | Latvakoski | H04L 12/2814 |
| 9,318,016 | B2 * | 4/2016 | Park | G08C 17/02 |
| 2005/0172321 | A1 * | 8/2005 | Kakuda | G08C 19/28 725/81 |
| 2006/0158368 | A1 * | 7/2006 | Walter | G08C 17/02 341/176 |
| 2007/0124772 | A1 * | 5/2007 | Bennett | H04N 21/485 725/61 |

(Continued)

FOREIGN PATENT DOCUMENTS

| | | | | |
|---|---|---|---|---|
| CN | 204206548 U | * | 3/2015 | Y02B 20/48 |
| WO | 2010/057153 A1 | | 5/2010 | |

*Primary Examiner* — Quan-Zhen Wang
*Assistant Examiner* — Chico A Foxx
(74) *Attorney, Agent, or Firm* — Drinker Biddle & Reath LLP

(57) ABSTRACT

A control system for equipment wherein a control unit which acts remotely in relation to the equipment runs an application for the control of the equipment, the equipment not having a data store for the application. The control unit especially obtains circuit data which the equipment comprises, for controlling operation of the equipment, and addresses the circuit via a wireless connection in order to transmit, to the equipment, control data in accordance with the obtained circuit data and relating to the running of the application by means of the control unit.

12 Claims, 3 Drawing Sheets

(56) References Cited

U.S. PATENT DOCUMENTS

| | | | | |
|---|---|---|---|---|
| 2009/0026978 | A1* | 1/2009 | Robinson | H05B 37/0272 315/294 |
| 2010/0138764 | A1* | 6/2010 | Hatambeiki | G08C 17/02 715/765 |
| 2010/0289685 | A1* | 11/2010 | Pratt | G08C 17/02 341/176 |
| 2011/0099264 | A1* | 4/2011 | Chapin | H04L 41/12 709/224 |
| 2012/0108293 | A1* | 5/2012 | Law | G06F 17/30056 455/557 |
| 2012/0324366 | A1* | 12/2012 | Latvakoski | H04L 12/2814 715/740 |
| 2013/0057395 | A1* | 3/2013 | Ohashi | G08C 17/02 340/12.5 |
| 2013/0086245 | A1* | 4/2013 | Lu | G05B 13/02 709/223 |
| 2013/0147612 | A1* | 6/2013 | Hong | G08C 19/00 340/12.54 |
| 2013/0225154 | A1* | 8/2013 | Park | G08C 17/02 455/420 |
| 2013/0258918 | A1* | 10/2013 | Rudland | G08C 17/02 370/310 |
| 2014/0070919 | A1* | 3/2014 | Jackson | G08C 17/02 340/5.61 |
| 2014/0075075 | A1* | 3/2014 | Morrill | G06F 1/1632 710/303 |
| 2015/0148921 | A1* | 5/2015 | Ito | G08C 17/02 700/66 |

* cited by examiner

UNIVERSAL EQUIPMENT CONTROL SYSTEM

CROSS-REFERENCE TO RELATED APPLICATIONS

This application is the U.S. national phase of the International Patent Application No. PCT/FR2015/050296 filed Feb. 9, 2015, which claims the benefit of French Application No. 14 51153 filed Feb. 14, 2014, the entire content of which is incorporated herein by reference.

BACKGROUND

The present invention relates to the control of devices, particularly for driving the operation of such devices.

The device may be, for example, home automation equipment such as a sound reproduction system (stereo or other device), a lighting device including at least one lamp, a detection unit comprising one or more sensors (for example to detect intrusion or the release of toxic gases, or others), one or more electric heaters, or other devices.

Conventionally, known devices are pre-programmed to run a limited number of applications. For example, a lighting device may comprise a processor and memory to store application data in order to execute predefined programs such as turning itself on and off at predetermined times or as indicated by a presence sensor, or blinking for mood lighting.

However, the use of such device is fixed according to their preprogramming.

SUMMARY

The present invention improves the situation.

For this purpose, it proposes a method for controlling a device, wherein a control unit which acts remotely in relation to the device executes an application to control the device, the device not having storage for the application data. In particular, the method, executed by the control unit, comprises the steps of:

- obtaining data concerning the circuit comprised in the device, in order to control the operation of the device, and
- communicating with the circuit via a wireless link in order to transmit control data to the device that are consistent with the obtained circuit data and that relate to execution of the application on the control unit.

The invention thus proposes offloading the execution of the application, and in particular the calculations related to the application, to the remote control unit, and transmitting only low-level operating data to the device by communicating with the device circuit directly.

According to one of the advantages that can then be provided by the invention, the device can be without any sophisticated computer means (a processor for complex calculations or a high memory capacity), which reduces the manufacturing cost of such a device. In addition, the remote control unit can execute a plurality of applications for controlling a plurality of possible programs for the operation of the device. The operation of the device is therefore not limited to a choice preprogrammed by the manufacturer or predetermined by its memory capacity or computation capabilities.

The control unit can command a plurality of devices. For example, in one embodiment, there may be a lookup table providing the circuit data for a device based on a device identifier provided as input to the table. This device identifier is used to fetch from the lookup table all data relating to its circuit and necessary for remotely controlling the device with the control unit. The device identifier may be data such as a string of characters or a bar code or QRC, written on the sales packaging of the device or on the device itself.

Alternatively, this data is read by the control unit via wireless link. In such an embodiment, the control unit can:

- receive the device identifier from the device, via a wireless link, and
- obtain the circuit data for the device from the lookup table, in order to control the operation of the device.

The circuit data of the device may comprise, for example, circuit input/output data (for example input/output port address data for the circuit).

Additionally or alternatively, the circuit data include at least one control file specific to the device. Such a file may be of the type typically known as a "driver", which may include said input/output data for the circuit.

One will understand that in this embodiment, the control unit transmits to the device only low-level commands directly communicating with the hardware of the device. The "intelligence" necessary to execute the applications is offloaded to the control unit.

In one particular embodiment, it is then possible to have a terminal available to a user and comprising a wireless communication module, the terminal further comprising the above-mentioned control unit, the application being installed in the terminal and executed by the terminal.

The terminal may be, for example, a smartphone, a tablet, a laptop, or a desktop computer.

In an equivalent embodiment, the terminal may send the control data to a gateway, for example a home gateway, which interfaces between:

- a wide area network to which the terminal is connected, and
- a local area network, for example a wireless LAN, to which the device is connected in order to receive the control data.

The gateway thus relays the control data sent by the terminal to the device, via the wide area network.

Of course, in another embodiment, the terminal may send control data to the gateway via the local area network and the gateway sends these data to the device. Such an embodiment makes use of the long range of a home gateway to control the various devices present in a residence for example.

In an alternative embodiment, the terminal may simply relay control data for the device that originate from a remote server comprising the control unit. In this other possible embodiment, a terminal available to the user can access a web interface to manage user preferences concerning the execution of the application. This web interface communicates with a server comprising the control unit. The server can then send control data from the server to a gateway (for example a home gateway) and the gateway then relays these control data to the device.

In such an embodiment, calculation means provided in the "Cloud" are used to run the application.

According to one of the advantages of the invention, the control unit may be arranged to execute a plurality of applications for controlling the device. In such an embodiment, after an application is selected from among said plurality of applications, the method then comprises communicating with the circuit via the wireless link in order to transmit, to the device, control data relating to the execution of the selected application.

According to one of the other advantages of the invention, the control unit is arranged to execute an application for controlling multiple devices at the same time. In such an embodiment, the method then comprises the steps of:

obtaining circuit data for each device, in order to control the respective operations of the devices among the plurality of devices, and communicating with each circuit of a device among the plurality of devices via a wireless link in order to transmit, to the device, control data consistent with the device and relating to the execution of the application on the control unit.

It is then understood that the invention allows creating new forms of applications that are capable of controlling multiple types of devices at the same time, such as a sound reproduction device playing audio content and a lighting device that illuminates at varying intensities according to the sound level of the content, doing so under the control of the control unit.

In one embodiment, the method further comprises a step, implemented by the control unit, of receiving data from the device via a wireless link. For example, in the case where the device comprises a sensor, these data from the device may contain measurements obtained by the sensor. Thus, for example, the data from the device may be used to produce the control data for another device.

Other example embodiments combining the control of different types of devices are given in the detailed description which follows.

The invention also provides a computer program comprising instructions for implementing the above method, when this program is executed by a processor. Such a program can be installed on the control unit in order to manage the low-level commands to one or more devices. A flowchart of the general algorithm of such a program is shown in FIG. 2 and commented below.

The invention also concerns a control unit:

comprising at least one module for executing an application for controlling a device, and connected to a wireless communication module in order to communicate to a circuit of the device the control data relating to the execution of the application on the control unit, for the implementation of the above method.

It is understood that the control unit may be integrated into a terminal of the type described above (and in the form of a computer module typically using a processor, memory, and a wireless communication interface), or may be incorporated into a server capable of sending control data to a gateway as described above, or may be integrated into the gateway itself.

The invention also relates to a device comprising a wireless communication module for receiving, on a circuit of the device, control data relating to an application executed on a remote control unit, for implementing the above method. As indicated, such a device may only have an identifier stored in memory, which it provides when queried by a control unit which enables the control unit to determine its circuit data.

BRIEF DESCRIPTION OF THE DRAWINGS

Other features and advantages of the invention will become apparent upon examining the following detailed description of some exemplary embodiments, and the accompanying drawings in which.

DETAILED DESCRIPTION

Figure 1:
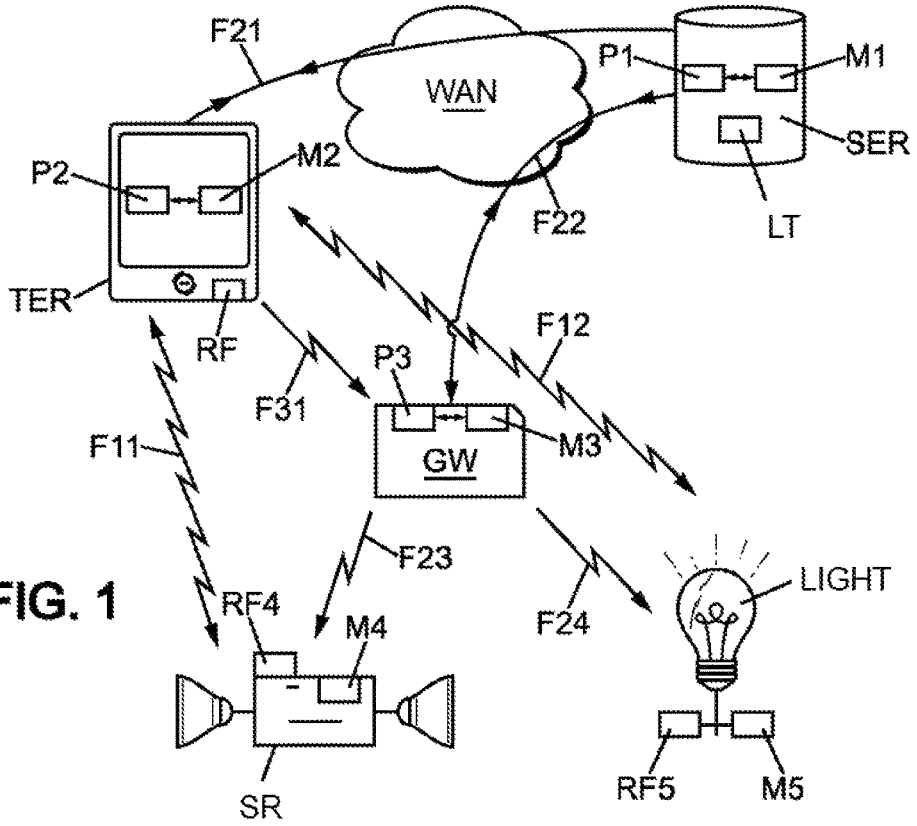
FIG. 1 illustrates an example implementation of the invention.

Referring to FIG. 1, a device such as a sound reproduction device SR, a lighting device LIGHT, or other device comprises a wireless communication module (respectively RF4, RF5) and memory (respectively M4, M5) which stores, in the example represented, an identifier specific to the device (or more specifically to the type of device having a specific given circuit).

A terminal TER accessible to a user can then run an application (typically by means of a processor P2, cooperating with working memory and/or storage M2). It can then send control data directly to the circuits of the device via a wireless communication module RF, using a wireless link (arrows F11 and F12 respectively).

To do this, in a preliminary step, the terminal TER may query each of the devices via the wireless link (for example NFC, Zigbee, WiFi, Bluetooth, or other connection) and retrieve the respective identifiers of the device in order to determine the data concerning the device circuits (typically the input/output data for these circuits). Typically these are data from a "driver" file containing data relating to the hardware input/output ports of the device circuits. Such data may be provided by a remote server SER storing a lookup table LT which receives as input a device identifier sent by the terminal and outputs the circuit data for the device (double arrow F21).

The calculations related to execution of the application are thus carried out by a control unit which may be installed in the terminal (for example in the form of a computer module using the processor P2 and the memory M2 of the terminal). This control unit carries out the calculations related to execution of the application and then determines the low-level commands to be addressed directly to the circuit of the device. More particularly, these low-level commands are transmitted to the wireless communication module RF of the terminal (for example an interface that is WiFi, or Bluetooth, or Zigbee, or NFC, or some other interface) which sends them to the wireless communication module or modules RF4, RF5 of the devices. These low-level commands, once received by a communication module of a device, are then sent to the circuit of the device in order to control the operation of the device directly (instructions sent on the fly to turn on or off one or more designated lamps, for example). The devices thus only execute low-level commands sent by the terminal.

In an alternative or additional embodiment, the terminal, for example for another application, may access a web interface to adjust the settings of an application executed on a server SER that comprises a processor P1 and memory M1 for this purpose. The server may then issue low-level commands to a gateway GW between the wide area network WAN (which is connected to the server SER) and a local area network to which the devices SR and LIGHT are connected. Next, the gateway GW relays the low-level commands to the devices SR and LIGHT via a wireless link (arrows F23 and F24).

In yet another variant, the application may be executed by the gateway GW and receive, for example via a wireless link, parameters selected by a user on the terminal TER (arrow 31). To this end, the gateway may itself comprise a processor P3 and memory M3 for performing the calculations related to execution of the application.

In yet another variant, the method may be implemented by different hardware, as follows. A near-field communication (NFC) card or a terminal fetches the identifiers of the devices SR and LIGHT via an NFC link. The terminal then sends these identifiers to a remote server; or via a second near-field communication link, this time between the card and the gateway GW, the gateway retrieves the device identifiers and sends them to a remote server. The remote server runs a given application in order to deliver low-level instructions to the devices via the terminal, or via the gateway and the card.

Figure 2:
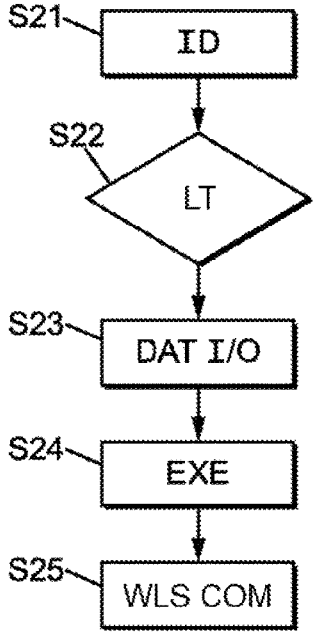
FIG. 2 illustrates the main steps of an exemplary method in the sense of the invention.

Represented in FIG. 2 are the different steps carried out in an exemplary embodiment of the invention (independent of the type of hardware used for the implementation). After a first step S21 of retrieving an identifier ID of a device, a lookup table LT is accessed in step S22 in order to determine in step S23 the input/output data of a circuit of the device. Next, the application is executed in step S24 (on a terminal, a server, a gateway, or other means) and the control data from this execution are sent to the device in step S25, via a wireless link. In particular, these control commands are in keeping with the input/output data for the device circuit, so that the data can be directly interpreted by the circuit.

Of course, the exemplary embodiments discussed above, particularly with reference to FIG. 1, are not to be interpreted restrictively and are intended to explain the general principles relating to the invention. Indeed, most industrial automation or automation for the general public may use PLCs or small processors connected to inputs and outputs used by a particular application. Since currently there are often duplicate PLCs/processors for a given application for a device, it is proposed to offload the inputs and outputs of the PLC/processor to a specific device, the link between the processor and the device being established after identification by an NFC-type mechanism or other wireless communication technique.

The advantages of the solution are:

- it reduces the costs of the necessary portion containing the inputs and outputs of the circuit, minimizing the device circuit due to offloading the low-level command processes with an identification process;
- it allows emulating the "calculator" portion on a central processing unit (on a mobile device, server, or other) communicating for example with a plurality of I/O circuits, eliminating specific hardware requirements for the applications,
- it simplifies pairing the input/output of a device circuit with the central processing unit by specifying the configuration of the necessary parts of these two elements during a prior step via the simple use of NFC or radio frequency,
- it enables secure offloading of the input/output (I/O) associated with a control process.

Of course, household applications of the invention may be provided as well as industrial applications, which allows reducing the costs of installed devices by reducing the risks associated with the installation of expensive processors in hostile environments, or by simplifying the maintenance and replacement of the I/O of a device.

Furthermore, in an application intended for a user of a terminal provided with a wireless communication module (for example a smartphone or tablet, or some other terminal), one can:

- develop an emulator application that is loaded on the device, and that also has a user interface (GUI) for configuring the objects (the devices and control processes);
- also develop: a remote input/output module in the form of an I/O card enabling NFC reads, with the few inputs and outputs identical to those of the device; a radiofrequency module needed for remote communication between the module and the terminal (for example Bluetooth 4 or other); and an NFC module that enables pairing the I/O card to the terminal where the emulator/GUI is located;
- also provide a development platform for configuring the pairing of the I/O card, and the physical characteristics of the card. This platform may also provide a server in the Cloud where the programs associated with the objects may be provided.

It is then possible to create an object (a process for a given type of device) that uses the I/O card. In an exemplary embodiment, the I/O card may be installed in the device in the form of an I/O module. The device may be a lamp in the exemplary embodiment given below. In this case, the lamp switch may be connected to the I/O module. It is then possible to develop the computer code required for this device (blinking for example). The lamp can then be used with the application/GUI. Thus only the I/O module is installed in the lamp and its NFC reference is configured to point to the program for the lamp.

When a user buys a lamp that is compatible with this application, at installation the user brings the terminal close to the lamp in order to pair them via an NFC read that triggers a search for the software associated with this lamp. The terminal retrieves this software into the emulator/GUI. The software configures the radio frequency communication (Bluetooth for example) between the terminal and the I/O module of the lamp, and presents in the GUI interface the possible functions of the lamp (turning on and blinking) and any programs provided for use.

The user can then choose in the application/GUI to associate an available function of choice (which may be generic, such as receiving an email, or specific to the lamp and provided by the manufacturer, or associated with a third-party application, or other). For example, when receiving a new email, the lamp will blink three times. Otherwise it remains off or on at the user's choice.

The program can continue to run, for example when the user leaves home with his or her terminal causing the devices lose their connection, by applying a default status (lamp off, for example). When the user returns home, the terminal detects the devices via Bluetooth, initiates a reconnect, and then its application/GUI applies any updates to the status of the devices.

We now refer to FIG. 3 to describe an exemplary embodiment in which a specific device is provided as the control unit, hereinafter called the "central unit" CU, and there are circuits specific to the device (connected to the device, for example to a light switch), hereinafter called "remote units" RU1, RU2.

The central unit CU may be a PLC and/or a processor. It has one or more input/output ports I/O numbered from 1 to n. These ports may have specific functions, pinouts, and electrical characteristics.

A user has a remote unit RU with its own I/O port. This unit RU is assumed to be associated with a configuration "k" of the inputs/outputs I/O of the central unit.

This remote unit RU has an identifier (serial number for example) that indicates both the type of input/output I/O ("k" in the example) and a unique identifier that is characteristic of the remote unit.

We will now first describe the activation and connection of remote unit RU1.

The remote unit approaches the central unit to complete the pairing. This can be done in at least two ways:

- the remote unit RU1 is brought physically close to the central unit (arrow 3*a*) to establish an NFC connection, and the pairing is done directly;
- the remote unit RU1 is brought physically close to a communication terminal TER and software installed on the terminal establishes a connection with the central unit CU, via a telecommunications network (for example the wide area network WAN), in order to carry out the same pairing mechanism (arrow 3*b*).

The remote unit then changes from an inactive state RU1 to an active state RU2. It can then move away from the central unit (arrow 3*a*) or from the communication terminal used as a relay (arrow 3*b*).

The remote unit RU2 then remains active. However, it can only receive information from and send it to the central unit in the following cases:

- when the remote unit RU can access the central unit, since they are connected to the same wireless local area network LAN (arrow 5*a*),
- or when the remote unit can access the central unit using the mobile device as a router (arrow 5*b*).

In the latter two cases, the connections between the remote unit and the central unit, or between the remote unit and the mobile device, may be established with any type of local wireless communication (NFC, Bluetooth, Zigbee, or other types).

Figure 3:
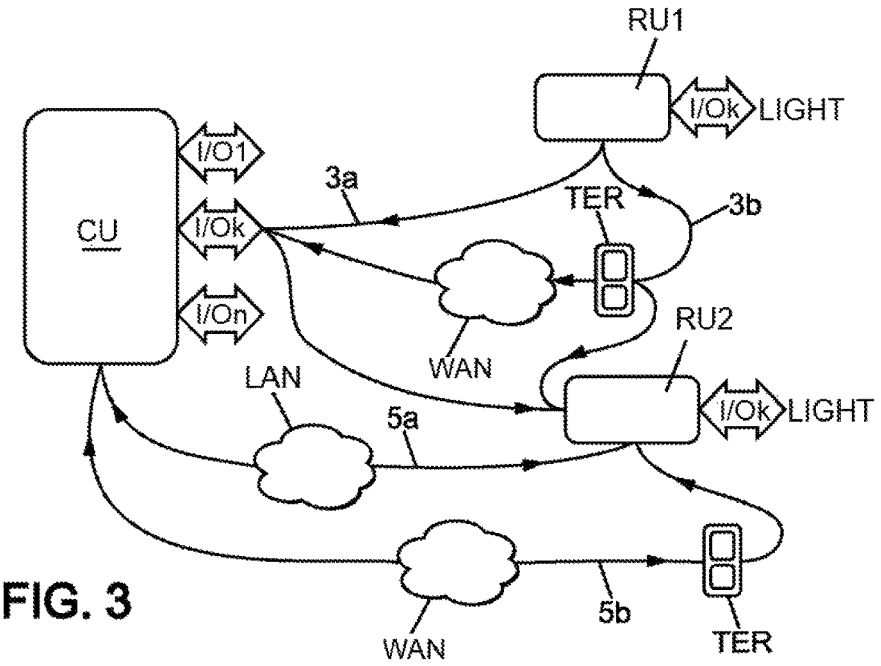
FIG. 3 illustrates the pairing between a control unit UP and a circuit DU1 of a device.

We will now describe initiating the operation of such a system, after the pairing illustrated in FIG. 3.

The remote unit RU is initially inactive. It has not been "recognized" by the central unit and does not have the software needed to operate it, at this stage at least. However, it does contain a unique identifier that can be used to find its type (particularly its type of inputs/outputs). The remote unit is brought closer to the central unit for pairing in one of the manners (arrows 3*a*, 3*b*) presented above with reference to FIG. 3.

The remote unit RU then provides the central unit CU with its unique identifier. Next, in one embodiment, the central unit CU may query a remote unit identification server (after receiving an identifier) that provides specific applications known as APIs ("Application Programming Interface"). This server SER is functionally separate from the central unit and may be accessed via a wide area network (or a local one via a gateway), or may even be present in the same physical machine as the central unit CU.

The unique identifier of the remote unit allows the service to recognize the type of input/output managed by the remote unit RU (and incidentally to retrieve some service information: manufacturer, hardware and software version, etc.).

The identification service that provides the APIs returns, to the central unit, the set of hardware and software information needed to control the remote unit (in particular the necessary driver software and the functions offered by the control and programming interface).

This information is stored by the central unit CU in its own API manager, referenced G-API. It is through this function that the central unit remembers all remote units that have been paired with it, their identifiers, and all the drivers necessary for controlling them.

The remote unit is then activated by the central unit in two ways:

- when the remote unit can access the central unit, because they are on the same wireless local area network LAN (for example the home network) (arrow 7*a*), or
- when the remote unit can access the central unit using the mobile device as a router (arrow 7*b*).

Thus, when the link between the remote unit and the central unit is operational (typically when the remote unit is accessible to the central unit via a local area network or via the wide area network and a router), the central unit CU can control the input/output ports of the remote unit RU and/or possibly receive signals from it (sensor measurements for example).

No assumptions are made concerning the level of intelligence of the various remote units. Also note that some remote units may possibly receive additional information such as an update to their basic software or security information.

The central unit thus offers access, via an open access service available to application programs, to all the APIs of the remote units associated with it. Any new application requesting these APIs can thus control one or more remote units associated with the central unit, with logic specific to that application.

Figure 5:
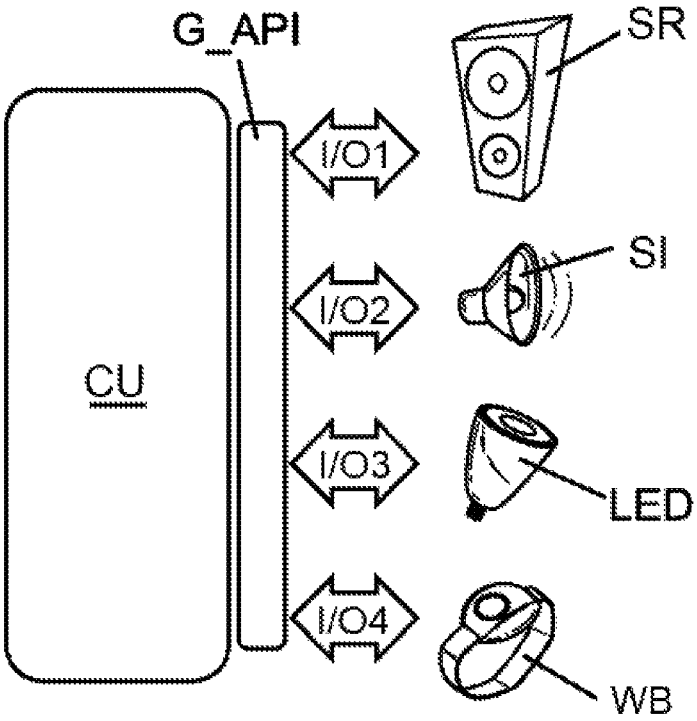
FIG. 5 illustrates an exemplary embodiment using four devices SR, SP, LED, WB for at least two applications.

We will now describe, with reference to FIG. 5, an exemplary embodiment of an application using four devices at once. More particularly, we will present two possible cases with two applications simultaneously present which can communicate with four devices.

Four devices are assumed here to be paired with the central unit CU, according to the procedure described above, which in this example are an audio speaker for sound reproduction RS, a loudspeaker SP for example of an indoor siren, a lamp LED also including a speaker, and a fall detection wristband WB.

In this example, the four devices each include a remote unit RU of the above type and are assumed to be connected to the central unit CU via Bluetooth.

Figure 4:
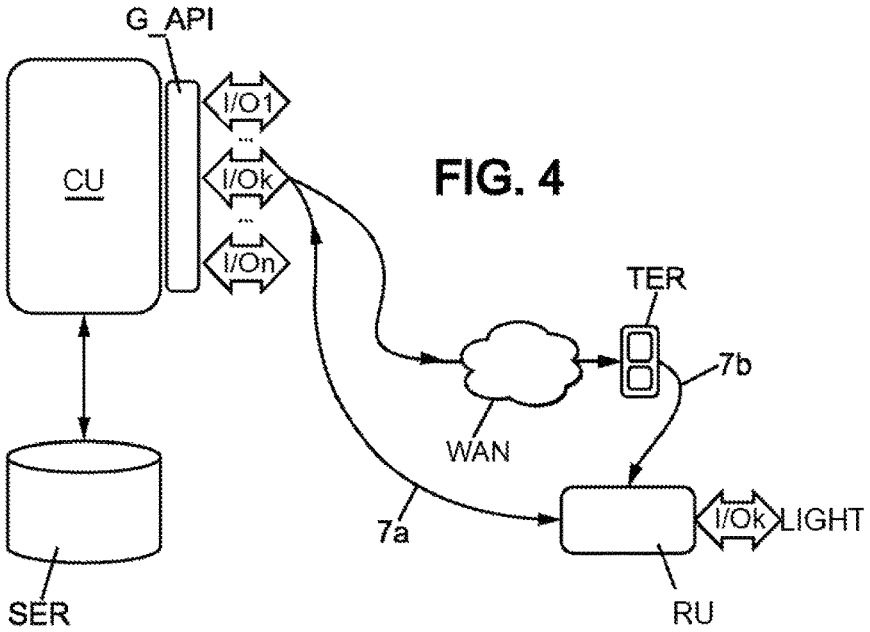
FIG. 4 illustrates the operation of a device in cooperation with the control unit UP.

After pairing, the APIs of the remote units of the four devices (in other words the circuits of these devices for example connected to a switch for turning on a lamp or connected to a sensor in order to receive a signal directly from the sensor) are made available to the applications after lookup on the server SER described above with reference to FIG. 4.

For this example, assume that the proposed APIs provide access to the following functions:

- for the audio speaker RS:
  - sending an audio segment (chosen by the application)
- for the indoor siren SI:
  - controlling and shutting off the alarm (the application here only has the ability to start or stop the signal),
- for the LED lamp:
  - controlling and shutting off the lamp,
  - sending an audio segment (chosen by the application)
- for the fall detection wristband WB:
  - presence and motion detection,
  - receipt by the application of an alert signal if there is a fall.

Using these APIs, two different applications can thus simultaneously access the APIs communicating with these devices. Presumably these applications run in the background.

For example, an ambiance application communicates with and controls devices SR, LED, and WB. Device SI is not used here.

When the user wearing the wristband WB enters the house, the central unit sends notice of the detected presence to the application. The application can then, simultaneously or successively:

send a command to device LED to turn itself on, and an audio segment (for example a welcome audio clip), and send to device SR a second audio segment (for example background music).

When the user leaves the house, the application is notified (loss of wristband presence detection) and can turn off the light from device LED as well as and the current audio segments on devices SR and LED.

Another application, a security application, may communicate with and control all devices. If the user falls, the wristband WB sends a signal, which is transmitted to the application by the API of the central unit. This application can then:

simultaneously send an audio message to devices SR and LED, for example to try to wake the user, at the same time, blink the lamp of device LED to draw his or her attention in another manner, and after a preprogrammed period (configurable in the application), if no signal of new movement is sent from the wristband WB, calling for help by controlling the inside siren SI (to inform the neighbors, for example).

It is understood that in this case all the intelligence is in the applications. The APIs opened by the central unit only manage low-level functions of the various circuits of the device.

Of course, the invention is not limited to the embodiments described above by way of example; it extends to other variants.

For example, an embodiment was described above with reference to FIG. 1 in which the control unit is installed in a communication terminal, or in a remote server, to carry out the calculations related to an application. However, as described above with reference to FIGS. 3 to 5, the control unit may be installed in a specific device, such as said central unit CU. A terminal may be used to select application settings (ambiance or security, for example, by using a user interface of the terminal to select music or a type of soft lighting, or a period of delay before an alarm). The calculations of the application may be executed on the terminal or on the control unit, but the control application itself, particularly with the conversion of commands to be interpreted by the circuit of a device, is then performed by the control unit in the sense of the invention.

The invention claimed is:

1. A method for controlling a device comprising a circuit having input/output ports, a memory storing an identifier, and a wireless communication module, wherein a control unit which acts remotely in relation to the device executes an application to control the device, the device not having storage to store application data of said application, the method, executed by the control unit, comprising the steps of:

obtaining the identifier from the wireless communication module in communication with the memory, wherein the identifier is specific to the device's type and is used to obtain data concerning the circuit comprised in the device and related to at least the input/output ports of said circuit, in order to control directly the operation of the device from the control unit and through the input/output ports of the device circuit, and communicating with the circuit via a wireless link in order to transmit data of low-level commands to said input/output ports of the device via the wireless communication module, said low-level commands being consistent with the obtained circuit data and relating to execution of the application on the control unit corresponding to a desired control operation of the device.

2. The method according to claim 1, wherein a lookup table is provided that delivers the data concerning the circuit comprised in the device based on the device identifier provided as input to the lookup table.

3. The method according to claim 2, wherein the control unit:

obtains the circuit data for the device from the lookup table, in order to control the operation of the device.

4. The method according to claim 1, wherein the circuit data of the device comprises input/output data of the circuit.

5. The method according to claim 1, wherein said circuit data include at least one driver specific to the device.

6. The method according to claim 1, wherein a terminal available to a user and comprising a wireless communication module further comprises said control unit, said application being installed in the terminal.

7. The method according to claim 1, wherein the control unit is arranged to execute a plurality of applications for controlling the device, the method further comprising, after an application is selected from among said plurality of applications, communicating with the circuit via the wireless link in order to transmit, to the device, control data relating to the execution of the selected application.

8. The method according to claim 1, wherein the control unit is arranged to execute an application for controlling a plurality of devices at the same time, the method comprising the steps of:

obtaining circuit data for each device, in order to control respective operations of the devices among the plurality of devices, and communicating with each circuit of a respective device among the plurality of devices via a wireless link in order to transmit, to the device, control data consistent with the circuit data obtained for the device and relating to the execution of the application on the control unit.

9. The method according to claim 1, further comprising a step, implemented by the control unit, of receiving data from the device via a wireless link.

10. The method according to claim 9, wherein, the device comprising a sensor, the data from the device contains measurements obtained by the sensor.

11. The method according to claim 9, wherein the control unit is arranged to execute the application for controlling a plurality of devices at the same time, the method comprising the steps of:

obtaining circuit data for each device, in order to control respective operations of devices among said plurality of devices, and communicating with each circuit of a respective device among said plurality of devices via a wireless link in order to transmit, to said respective device, control data consistent with the circuit data obtained for said respective device and relating to the execution of the application on the control unit, and wherein the data from a device of said plurality are used to produce the control data for another device of said plurality.

12. A non-transitory computer storage medium storing instructions of a computer program comprising instructions for controlling a device comprising a circuit having input/output ports, a memory storing an identifier, and a wireless communication module, wherein a control unit, remotely in relation with the device, comprising a processor performing the instructions of the program to execute an application to control the device, the device not having storage to store application data of said application, the instructions when executed by the control unit, comprising the steps of:

obtaining the identifier from the wireless communication module in communication with the memory, wherein the identifier is specific to the device's type and is used to obtain data concerning the circuit comprised in the device and related to at least the input/output ports of said circuit, in order to control directly the operation of the device from the control unit and through the input/output ports of the device circuit, and communicating with the circuit via a wireless link in order to transmit data of low-level commands to said input/output ports of the device via the wireless communication module, said low-level commands being consistent with the obtained circuit data and relating to execution of the application on the control unit corresponding to a desired control operation of the device.

* * * * *